219-121 SR
8/11/81 XR 4,282,940

United States Patent [19]
Salisbury et al.
[11] 4,282,940
[45] Aug. 11, 1981

[54] APPARATUS FOR PERFORATING OIL AND GAS WELLS

[75] Inventors: Winfield W. Salisbury, Scottsdale; Walter J. Stiles, Phoenix, both of Ariz.

[73] Assignee: Magnafrac, Fort Worth, Tex.

[21] Appl. No.: 74,497

[22] Filed: Sep. 11, 1979

Related U.S. Application Data

[62] Division of Ser. No. 894,261, Apr. 10, 1978, Pat. No. 4,199,034.

[51] Int. Cl.[3] ..... E21B 7/00
[52] U.S. Cl. ..... 175/11; 219/121 L
[58] Field of Search ..... 175/11, 16; 219/121 L; 166/248, 297, 308

[56] References Cited

U.S. PATENT DOCUMENTS

| | | | |
|---|---|---|---|
| 3,383,491 | 5/1968 | Muncheryan | 219/121 L |
| 3,461,964 | 8/1969 | Venghiattis | 175/16 X |
| 3,693,718 | 9/1972 | Stout | 175/16 X |
| 3,821,510 | 6/1974 | Muncheryan | 219/121 L |
| 4,061,190 | 12/1977 | Bloomfield | 166/248 X |
| 4,090,572 | 5/1978 | Welch | 299/14 |
| 4,113,036 | 9/1978 | Stout | 166/248 X |

*Primary Examiner*—James A. Leppink
*Assistant Examiner*—Richard E. Favreau
*Attorney, Agent, or Firm*—Richards, Harris & Medlock

[57] ABSTRACT

A system for perforating the subsurface formation located in the area of an oil or gas bore hole in which a high powered coherent light beam axially is directed along the bore hole to a predetermined depth therein from a surface location, the beam is deflected at said depth along a deflected beam axis. The beam is focused at said depth to concentrate the beam at each of a plurality of spaced focal points along the deflected beam axis. There is provided (1) a significant increase in the distance (length) to which the calculated oil or gas bearing formations can be perforated (from a present nominal 18 inches to 200 feet or more), thus providing the opportunity for increased yield; and (2) an accurate determination of the exact near horizontal plan orientation of such perforations so that each can be aimed in the direction of the most promising formation pay zone.

3 Claims, 8 Drawing Figures

APPARATUS FOR PERFORATING OIL AND GAS WELLS

This application is a division of U.S. patent application Ser. No. 894,261, filed Apr. 10, 1978, now U.S. Pat. No. 4,199,034, which issued Apr. 22, 1980.

BACKGROUND OF THE INVENTION AND CROSS REFERENCE TO RELATED ART

The present invention relates to the art of well perforation and, more particularly, concerns a novel method and apparatus for drilling new and/or extending existing perforation holes within existing or new oil and gas wells or similar excavations.

It is conventional practice after a well has been drilled and cased to its desired depth, to perforate a bore hole with one or more ⅜" to 1" diameter holes at the depth of the lowest most promising formation. For each perforation to be made, a projectile is discharged at a velocity sufficient to cause it to penetrate, or burn a hole through, the well casing and cement and out to approximately 18 inches into the formation.

Promising oil bearing formations vary vertically from five feet to as much as several hundred feet. Normal practice is to perforate one to four holes (through the steel casing) for every vertical foot of promising formation. The depth to which the steel casing is normally set extends approximately fifty feet below the level of the bottommost perforation to what is normally termed the bore hole bottom. The production string of casing is then cemented using a float collar and a guide shoe to support the cement column behind (outside) the casing to a point above the highest point to be tested for production. A packer is next run on tubing and set in the casing approximately ten feet above the top perforation. This packer is designed mechanically to fit pressure tight against the inner sidewalls of the casing and is normally not moved, once set. It has a circular center opening and it is through this opening that the geled water and sand mixture or acid, known as the fracing or treating solution, is passed on its way into the perforated area and the oil bearing formation through the perforation holes made by the bullet or jet shots.

The pump pressure behind this fracing or treating solution varies from a few hundred p.s.i. to several thousand p.s.i. depending upon how much pressure is required to open up the formation so it will accept the fracing or treating solution.

Once the fracing solution has, under high pressure, transported the sand into the openings (fractures) in the formation and lodged the sand there, the high fracing pressure is released and the geled solution and the hard sand separate. After this release of the high fracing pressure, the separated geled solution either flows back into the well bore hole or is carried there by the first flow of oil as the latter comes out of the formation and flows into the well casing on its way to the surface.

Because the horizontal orientation of the perforation producing projectile cannot accurately be predetermined or controlled from the surface, the resulting pattern of perforations created at the formation level has heretofore been essentially unpredictable. This, of course, is disadvantageous because the formation may not be perforated in the proper direction to maximize recovery flow. Similarly, as previously indicated, present methods permit only limited penetration by the perforation bullet into the formation (nominally up to 18") thereby often limiting the area of the pay zone from which recovery flow can be achieved.

Utilization of the laser energy has been heretofore applied in earth boring applications. For example, applications involving use of a laser power capability in the region of 10,000 kilowatts are disclosed in Salisbury and Stiles U.S. Pat. Nos. 3,998,281 and 4,066,138, the disclosures of which are incorporated herein by this reference. Laser energy generators of such high continuous power capability are, at the present state-of-the-art, physically large, comparatively heavy and bulky and not subject to use in confined quarters such as a conventional well bore hole. This is true also of smaller single unit laser energy generators of low to medium power such as those currently available for unclassified use, in the 1 kilowatt to 200 kilowatt continuous power range.

Utilization of laser energy from surface mounted laser energy generators for the purpose of drilling perforation holes and/or the lengthening of existing perforation holes deep within a well's bore hole is further complicated by the fact that existing oil wells are not normally drilled in optically straight lines due to the fact that the bedding plane of the rock layers is not flat, causing the bit to drift with the dip of the rock formation. Laser energy, which does travel in an optically straight line, will not follow such bore hole drifting without some form of high efficiency laser energy channeling (laser transmission line).

BRIEF SUMMARY OF THE INVENTION

The present invention solves the foregoing problems by providing a method and apparatus for drilling horizontal holes at any predetermined depth in an existing or new oil well or other mineral or geothermal excavation or to extend such an existing or new hole within an existing or new excavation in any direction by means of laser beam energy from a laser or lasers located at the earth's surface or any other convenient location.

Since existing oil wells are not usually drilled in optically straight lines some special method and/or apparatus or equipment are required to transmit the laser energy to the desired level or bottom of the hole or excavation where the laser beam can be applied to the geologic structure to produce by melting, perforating, fracturing and other programmed laser actions for producing such horizontal or extension holes desired for producing or increasing oil, gas, water, mineral or geothermal energy movement through existing or new perforation holes.

With the present invention there is provided a method of increasing the recovery flow from a bore hole casing of a gas or oil well be projecting a flow or perforation hole through the casing at the selected depth and through the adjoining subsurface formation and injecting a fracing solution into the top of the casing and through the flow hole, the method being characterized in that the flow hole is projected through the adjoining subsurface formation by generating a high-powered coherent light beam, transmitting the beam in axial path following relation through the casing from the top thereof to the selected depth therein, directing the transmitted beam laterally at the selected depth to drill a flow hole directed laterally through the casing, and controlling the beam to extend the lateral extension of the flow hole to a predetermined length.

In the preferred manner of practicing the method of the invention, a high powered coherent light beam is directed axially along the bore hole to a predetermined depth therein from a surface located laser energy generator. At the proper depths within the bore hole the laser beam is then deflected off-axis and along a predetermined deflected beam axis that is directed into the formation, and is successively optically focused and refocused to concentrate the beam energy at each of a plurality of spaced focal points along the deflected beam axis.

Apparatus for increasing the recovery flow from an oil or gas well by projecting a flow hole through the well casing and through the adjoining subsurface formation at a selected depth comprises in accordance with the invention surface mounted laser generator means. Light transmitting means, including means disposed in distributed relation within the casing, are provided to direct the beam in axial path following relation downwardly through the well casing from the surface to a selected depth therein. Laser beam control means within the casing at said depth receives the transmitted beam and directs the same laterally to project a flow hole through the casing and into the adjoining subsurface formation.

In accordance with the more particular aspect of the present invention a light pipe made of a bundle of parallel fibers of internal refracting transparent material, chosen for the laser beam wavelength being used, providing grazing incidence internal surface reflection, is utilized as the laser light transmitting vehicle. Optics at one end of the light pipe (proximate to the laser generator) redistributes the typical Gaussian energy distribution of a laser beam to a substantially uniform cross-sectional distribution. At the other end of the light pipe (proximate to the point of drilling) focusing optics are used to concentrate the laser energy. The focusing optics, according to a more particular and separate aspect of the invention, incorporate a variable focal length reflector unit capable of effecting a change of the focal length of the focusing optics from a few inches to a distance of greater than 200 feet or more. The focal length is varied so as to facilitate deeper penetration into the formation-as well as to minimize damage to shielding and structure housing the focusing optics.

Other features and advantages of the invention will be apparent from the following description and claims and are illustrated in the accompanying drawings which show structure embodying preferred features of the present invention and the principles thereof, and what is now considered to be the best mode in which to apply those principles.

BRIEF DESCRIPTION OF THE DRAWINGS

In the accompanying drawings forming a part of the specification, and in which like numerals are employed to designate like parts through the same.

DETAILED DESCRIPTION

Figure 1:
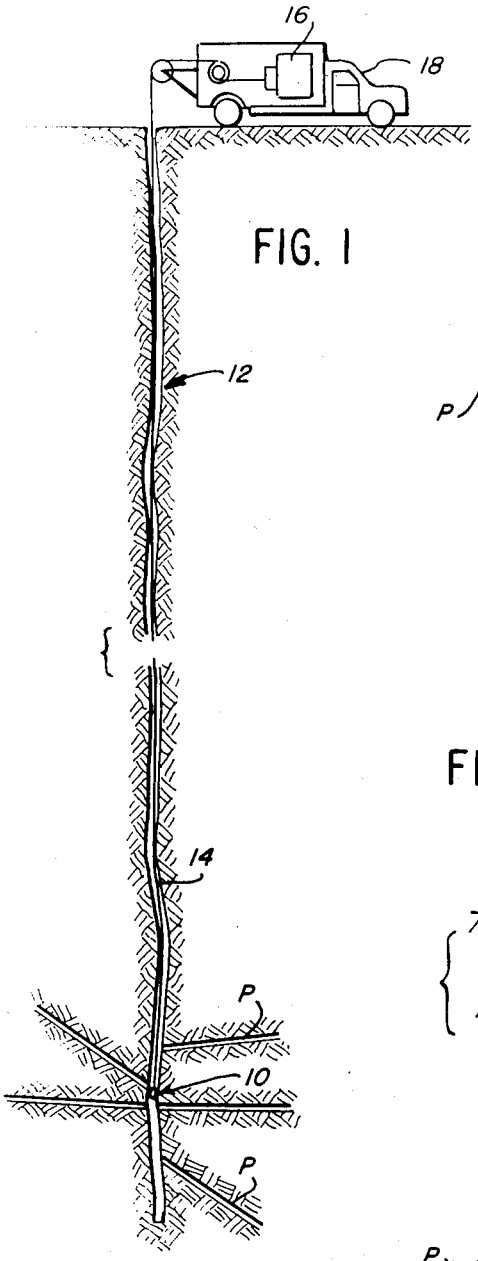
FIG. 1 is a diagrammatic in side elevation illustrating the basic system of the present invention and which shows the laser perforator unit lowered within an oil or gas well bore hole to the depth of the formation to accomplish perforation thereof.

Turning now to the drawings and specifically to FIG. 1, there is shown a laser perforator unit 10 which has been lowered into a bore hole 12 to the formation level in position to transmit perforation forming laser energy. As will be described hereinafter, the laser perforator unit 10 is capable of directing the laser energy so as to produce horizontal as well as slanted flow holes or perforation holes P in any controlled direction.

Figure 2:
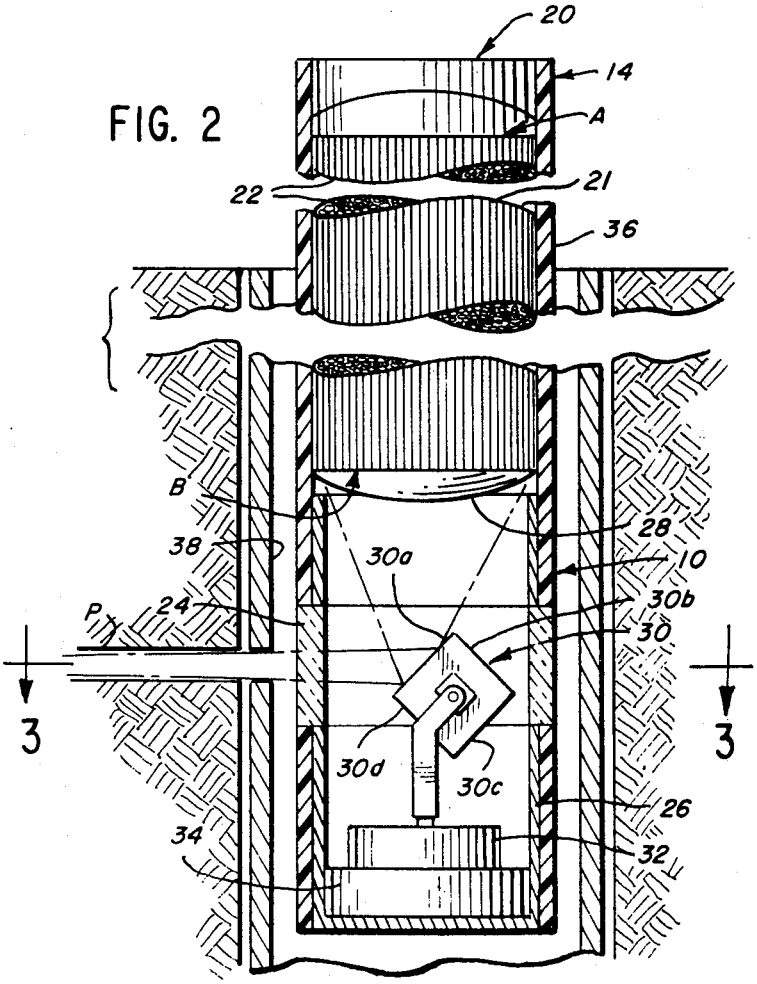
FIG. 2 is a detailed view of the laser light pipe and laser perforator unit.

As shown in FIGS. 1 and 2, the laser perforator unit 10 is supported by line 14 that includes a laser light pipe 21 comprising a bundle of fiber optics cables 22 for carrying the laser energy from a remote laser generator 16 to the perforator unit. In the illustrated embodiment, the remote laser generator and supporting control equipment 16 are carried by a perforation vehicle 18. For laser powers of 100 KW–200 KW several vehicles will be required for laser power generation. As will be described in detail, a high-powered coherent light beam from the laser generator 16 is optically directed to an input lens system 20. Normally energy from a laser has a Gaussian or other non-uniform distribution across its aperture. The input lens system functions to change the non-uniform distribution to uniform or near uniform distribution across the input A of the fiber optical light pipe 21. Anti-reflective coatings are on the lenses and fiber-optics input so little laser energy is lost at interfaces of the various surfaces.

Laser energy is conducted down the fiber optics cables 22 of light pipe 21, up to several inches in diameter and can carry sufficient energy down its full length to perform laser drilling and perforating assignments into rock formation at its down hole output end. The laser energy emerging from the fiber-optics cables 22 (up to several hundred killowatts or more) is focused by perforator unit 10 which directs the laser beam laterally, or at any tilt angle from the horizontal that may be dictated by formation conditions at or near the bottom of the bore hole.

As the laser beam drills laterally, control means of the perforator unit 10 will operate, as disclosed herein, to concentrate the beam energy at successively greater focal lengths to facilitate flow hole projection farther and farther from the center of the well bore hole. It will be appreciated that such also prevents the power density (watts/cm.$^2$) of the beam at the point of its exit through transparent shield 24 of the perforator unit 10 from eventually melting the same due to maintenance thereat of maximum energy levels. As will be discussed, the control means can comprise any one of numerous optical systems. It will further be apparent that lateral flow holes P, either horizontal or tilted above or below the horizontal can be drilled in this manner.

With reference to FIG. 2, in the preferred embodiment disclosed herein the laser perforator unit 10 includes a hollow cylindrical shaped housing structure 26 that includes a circumambient window 24 of laser beam transmitting material and an integral bottom base plate. Control means housed within the unit comprise a focusing lens 28 and a gimbal supported reflecting unit 30 that is driven by a suitable driver 32 for rotation about an axis aligned with the axis of the housing 26 and also to direct the beam to the desired vertical direction. Below this is a gyro-stabilizer-repeater unit 34 that is used to orient reflector 30 so the laser beam is directed in the desired, known-on-the-surfaces, direction. Gyro-stabilization also maintains the precise pointing of the lateral laser beam so that once a hole is started, it continues to bore that hole until the desired flow hole length is achieved. Gyro-stabilization systems suitable for this purpose can be obtained from a number of commercial sources such as Sperry Gyroscope, Minneapolis-Honeywell, as well as others.

The light pipe 21 comprising the bundle of light transmitting fiber optics cables 22 is encased in a protective sheath 36 that is impregnated with reinforcing stainless steel cables (not shown) to enable the sheath 36 to be capable of supporting the weight of the light pipe 21 and laser perforator unit 10. Power and control signals and monitoring are provided by control wires (not shown) built into the fiber optics cables 22 within sheath 36. Many suitable positioning mechanisms are available on the open market, and can be used to determine the azimuthal direction of the holes being drilled as well as providing variations in the vertical tilt angle above or below the horizontal plane.

Figure 3:
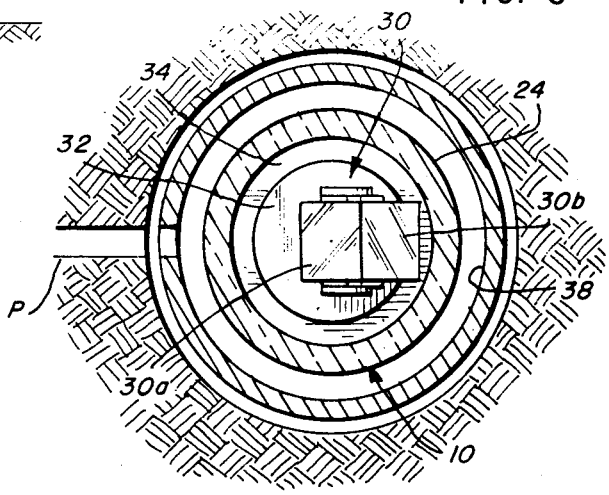
FIG. 3 is a sectional view taken, as indicated, along the line 3—3 of FIG. 2.
Figure 4:
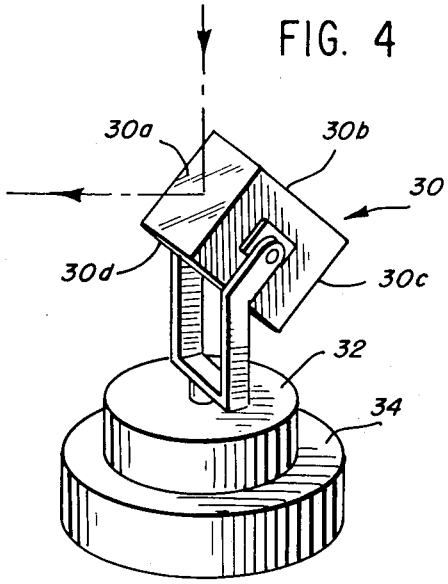
FIG. 4 is a detailed isometric showing the presently preferred reflector unit.
Figure 5:
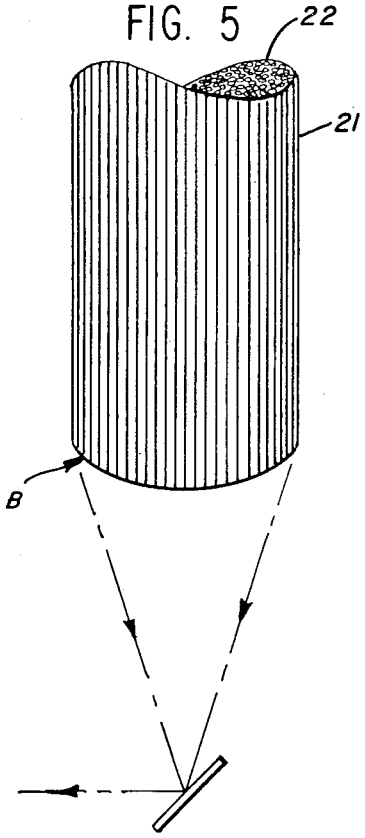
FIGS. 5–8 are fragmentary views showing alternative forms of beam concentrating and deflecting optics.

As best shown in FIGS. 3 and 4, the reflector unit 30 is of generally a rectangular cube configuration and includes several, typically four, reflecting surfaces 30*a*, 30*b*, 30*c* and 30*d*, each of which is configured to provide a different focal length for the system. Laser energy conducted down the fiber optics cables 22 is concentrated by a lens 28 and thereafter deflected by one of the reflecting faces of reflector unit 30. As shown in FIG. 2, the deflected laser beam propagates laterally and outwardly through the transparent window 24 and toward the bore hole casing 38. Initially, reflector unit 30 will present a reflecting surface of short focal length, sufficient to concentrate the laser energy at a point at or just beyond the bore hole casing. As the perforation hole is drilled by the action of the laser beam, reflector unit 30 is rotated so as to present reflection surfaces of successively greater focal length to facilitate drilling up to several hundred feet or more. As stated, for controlling the driver 32 and gyro stabilizer 34, suitable control and position repeater lines extend through the fiber optics cables 22 to the remote control 16.

With reference to FIGS. 5–8 alternative optical systems for concentrating and/or focusing the beam at the terminal end B of the light pipe 21 are there shown in diagrammatic form. Specifically, in the form of FIG. 5 the terminal end B of the fiber optics cables 22 is imbedded in plastic or other suitable material to stiffen the bundle and hold the individual fibers rigidly so as to effectively form a rod containing the fibers. The end of the rod is then ground to the proper optical curvature which focuses the laser energy just as if it were a lens. Thus laser energy emerges from the fiber optics cables 22 with a predetermined distance to a focal point. This energy is reflected from the beam deflecting mechanism as in FIGS. 2 and 3.

Figure 6:
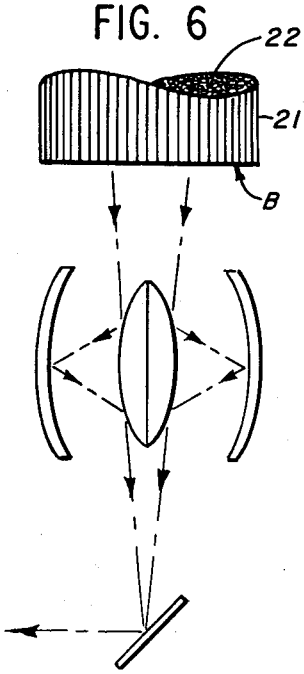
Figure 7:
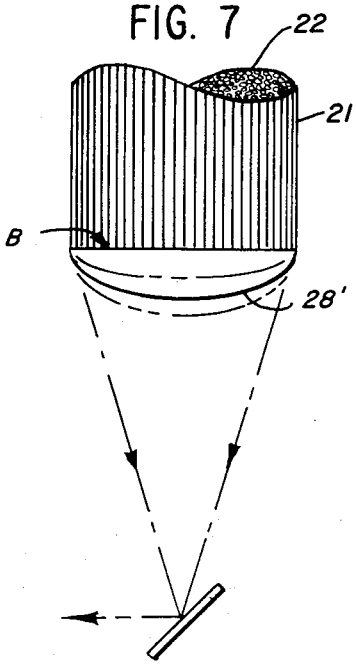

In the embodiment of FIG. 6 laser energy emerging from the fiber optics cables 22 is focused by a focusing system using convex and concave reflecting surfaces shown in the above referred to U.S. Pat. No. 3,998,281. In FIG. 7 there is shown a variable focal length lens 28' whose surface curvature, and consequently focal length, are varied by adjusting the fluid pressure inside the elastic surfaces by controls located at the surface.

Figure 8:
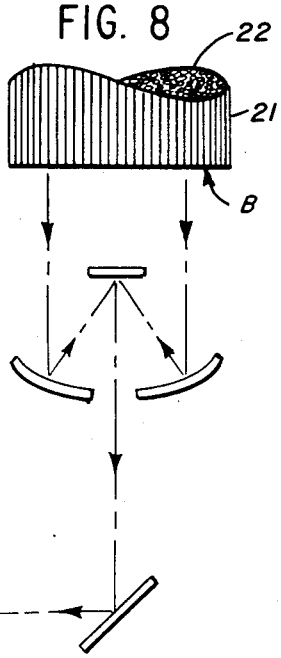

FIG. 8 illustrates a Schmidt optical configuration for focusing the laser energy. This, and the foregoing types of first surface reflecting and focusing systems, are well known in the optics field.

As previously mentioned, the light pipe 21 is made of a bundle of parallel fibers of laser beam transparent material, the material being chosen to match the laser wavelength being used, providing grazing incidence internal surface reflection to guide the laser light. Such a bundle of laser energy transmitting fibers can be quite flexible and at the same time can be designed to preserve the phase of coherent energy so that the laser energy emerging from the flexible fiber optics cables 22 has the same coherent focal, and focusable, properties as the energy originally entering the fiber bundle. Typically, laser light conducting fibers of low loss material, properly coated, provide conduction losses as low as 0.2 decibels or less per kilometer of length per fiber. This is sufficiently low that a long flexible fiber optics cables 22 can be constructed for which the losses are practical in terms of the energy transmitted and in terms of the ability of the fiber optics cables 22 to dissipate the energy transmission losses. This 0.2 decibels loss per kilometer represents a transmission of 0.95499 of the input power. If 100 kilowatts of laser power is sufficient at the input of the fiber optics cables 22 to produce perforation hole drilling at the output, the fiber optics cables 22 power transmission loss will be only 4.5 kilowatts per one kilometer of bore hole depth. This leaves 95.5 kilowatts available to do the perforation hole drilling, a quantity of power which is considered more than adequate. In fact, if two kilometers of fiber optics cable 22 is needed to reach the perforating hole drilling level (depth), only 8.8 kilowatts of the fiber optics cable 22 input laser power will be lost in transmission, leaving 91.2 kilowatts for useful application at the down hole perforation level. The fiber optics loss per meter thus approximates 5 watts in this example, an amount easily dissipated by the fiber optics cable 22 structure, particularly in view of the relatively short time duration of laser energy required to complete the perforating hole drilling process. In practice, a less efficient, and supposedly cheaper light pipe 21 than the one considered in the above example would work satisfactorily for depths of two or three kilometers or more (well depths to 10,000 feet) even in the hostile bore hole environment encountered at those depths. For a $CO_2$ laser, fiber optics cables 22 could be made of silicon fibers, or of small diameter hollow tubes with internal wall reflections. For instance, a 3" O.D. outside diameter fiber optics cable 22 has an external surface area of 2,394 sq. cms. per meter of length. A light pipe 21 of this size can dissipate, without damage, ten milliwatts per sq. cm., which is about 1/10 the radian energy received from direct noon sunlight. This approximates 24 watts per meter length of the cable 22, or 24 kilowatts per kilometer. Thus, without the need for any special cooling, 100 kilowatts of laser energy can be transmitted in a relatively inefficient fiber optics cable 22. In fact, a fiber optics cable 22 with an attenuation as high as 1.0 decibel per kilometer can be tolerated if such less efficient light pipe fibers prove to be sufficiently more economical.

Our invention has established the 3" O.D. specification for the flexible fiber optics cable 22 on the basis of unemcumbered clearance through a representative 4½" O.D. oil well seamless casing A.P.I. weighing approximately 15.10 pounds per foot, having 0.337" wall thickness and an effective inside diameter of 3,826" (grade U-150). Flexible fiber bundle light pipe 3" O.D. cables of 1 kilometer length are producible and can be readily coupled together involving coupling losses not exceeding 0.5 decibels. The potential laser power handling capability of a 3" O.D. flexible fiber optics cable 22 is calculated at 500 kilowatts.

The above are typical calculations. Other diameters and lengths of fiber optics cables 22 can be used, and will be, as oil well parameters dictate. Thus, the fiber bundle light pipe 21 is sufficiently flexible to feed through the bore hole even though such bore holes are not normally drilled in optically straight lines, and functions to transmit the laser beam through the bore hole in an axial path following relationship.

Down hole control, power and return telemetry wires as well as all necessary hydraulic lines are contained within, and protected by, the 3" O.D. flexible fiber optics cable structure. The cable's outer sheathing specifications provide a realistic safety margin for protection against the hostile mechanical and chemical environment and increasing bore hole temperatures and pressures encountered with depth as well as the necessity of supporting the considerable weight of the 3" O.D. cable proper in bore holes to depth of 8 kilometers and beyond.

An alternate to the use of a flexible light pipe to transmit laser energy for drilling purposes to various depths in an existing well is to use grazing incidence mirrors to redirect the coherent laser light to follow through a well casing, which is not optically straight. The redirecting mirrors are mounted on magnetic clutches so as to fasten to the side of the steel well casing at the appropriate place and with the proper angle to direct the light around the gradual bends of an existing well casing. The magnetic clutch for each mirror may be mechanically controlled by permanent magnets with adjustable keepers as is the practice with magnetic clutches or by electromagnets with current control. The angle of the mirror can also be controlled by means of appropriate pivots or axles and positioning servo motors. Such a mirror can be placed at each curve in the well casing so that the coherent laser power eventually reaches a depth where the energy is to be directed and focused for drilling purposes, methods similar to those outlined for use with a light pipe can be used for directing and focusing the laser drilling beam. This drilling can be done radially for increasing the flow from the geological strata to the well or for deepening the well.

A certain amount of surveying is required to determine the optimum adjustment of the deflecting mirrors. This will be done by the use of short, low power laser pulses which will scatter back from the deepest position reached by the pulse beam. A timing system of range measurement such as is used in radar gives the range of the light to the point where another mirror is needed or until the bottom of the well is reached. The laser ray directing and focusing means can then be placed in position to utilize the beam energy of the power laser beam for drilling purposes. The mirrors for this purpose will be provided with pulses of cleaning fluid to keep the reflecting surface in optimum reflecting condition. Also, this fluid and/or other cooling means will be made available to dissipate the absorbed heat in the mirror and its control and suspension system. Conducting and radiating means is also provided as necessary such as for example heat pipes and radiators or thermal contacts with the well casing so that the mirrors are protected at all times of use from overheating and/or distortion caused by losses or accidental improper contact with the powerful laser beam.

It will be appreciated that the duration of the laser pulses and the interval between focal length changeover will be subject to considerable variation depending on such factors as the physical properties of the formation being perforated.

From the foregoing, it will be apparent to those skilled in the art that there is herein shown and disclosed a new and useful method and apparatus for perforating oil and gas wells employing laser technology and applicants claim the benefit of a full range of equivalents within the scope of the appended claims.

What is claimed is:

1. Apparatus for increasing the recovery flow from a bore hole casing of an oil or gas well by projecting a flow hole through the casing and through adjoining subsurface formations at a selected depth, the apparatus comprising surface mounted laser generator means for generating a high-powered coherent light beam, transmitting means including a fiber optics cable having a bundle of fibers of internal refracting transparent material disposed in distributed relation within the casing for transmitting the beam in an axial path following relation through the casing from the top thereof to the selected depth therein, and beam control means within the casing at said depth for laterally deflecting the beam for focusing the deflected beam to project a flow hole laterally through the casing and the adjoining subsurface formations.

2. Apparatus for increasing the recovery flow from a bore hole casing and through adjoining subsurface formations at a selected depth, the apparatus comprising surface mounted laser generator means for generating a high-powered coherent light beam, transmitting means disposed in distributed relation within the casing for transmitting the beam in an axial path following relation through the casing from the top thereof to the selected depth therein, beam control means within the casing at said depth for laterally deflecting the beam and for focusing the deflected beam to project a flow hole laterally through the casing and the adjoining subsurface formations, said transmitting means cooperating with an input lens for transforming the typical Gaussian energy distribution of the laser beam to a substantially uniform cross-sectional distribution, and the transmitting means comprising a fiber optics cable having a bundle of fibers of internal refracting transparent material.

3. Apparatus as in claim 2 wherein said beam control means includes means for successively refocusing the laser beam to successively increasingly remote focal points to successively extend the projection of the flow hole.

* * * * *